US008448582B2

(12) United States Patent
Jian

(10) Patent No.: US 8,448,582 B2
(45) Date of Patent: May 28, 2013

(54) PLASTIC PALLET STRUCTURE

(75) Inventor: Bo-Xin Jian, New Taipei (TW)

(73) Assignee: Camry Packing Industrial Limited, New Taipei (TW)

( * ) Notice: Subject to any disclaimer, the term of this patent is extended or adjusted under 35 U.S.C. 154(b) by 70 days.

(21) Appl. No.: 13/211,488

(22) Filed: Aug. 17, 2011

(65) Prior Publication Data

US 2012/0298015 A1 Nov. 29, 2012

(30) Foreign Application Priority Data

May 23, 2011 (TW) ..... 100118022 A

(51) Int. Cl.
*B65D 19/16* (2006.01)

(52) U.S. Cl.
USPC ..... 108/56.3; 108/901

(58) Field of Classification Search
USPC ..... 108/53.1, 56.1, 56.3, 901–902
See application file for complete search history.

(56) References Cited

U.S. PATENT DOCUMENTS 3,469,542 A * 9/1969 Ahlenius ..... 108/56.1
4,359,948 A * 11/1982 Judy et al. ..... 108/56.1
4,735,154 A * 4/1988 Hemery ..... 108/56.1
4,869,179 A * 9/1989 Sammons et al. ..... 108/56.1
5,357,875 A * 10/1994 Winebarger et al. ..... 108/51.3
5,417,167 A * 5/1995 Sadr ..... 108/57.19
5,487,345 A * 1/1996 Winebarger et al. ..... 108/51.3
5,950,546 A * 9/1999 Brown et al. ..... 108/56.1
6,155,181 A * 12/2000 Chilcutt ..... 108/51.3
6,837,170 B2 * 1/2005 Taft ..... 108/57.25
6,892,651 B1 * 5/2005 Van Reed et al. ..... 108/56.1
8,113,129 B1 * 2/2012 Hurley et al. ..... 108/51.3
2003/0005862 A1 * 1/2003 Halavais ..... 108/56.1
2004/0226490 A1 * 11/2004 Polumbaum ..... 108/56.1
2008/0066657 A1 * 3/2008 Kuo ..... 108/57.19

FOREIGN PATENT DOCUMENTS

GB 2272203 A * 5/1994

* cited by examiner

*Primary Examiner* — Hahn V Tran
(74) *Attorney, Agent, or Firm* — Rabin & Berdo, P.C.

(57) ABSTRACT

A plastic pallet structure, includes a plurality of bases. Each base includes a basic portion, the basic portion includes an opening clamping portion, an arch bridge, an extension portion, an arch bridge portion, first and second supporting portions, the complete base is formed by means of plastic precasting and by coupling a mesh-typed sheet body to every section. The opening clamping portion is disposed with a slide-in slot. To increase the bearing capacity thereof a space for accepting a metal bar may be disposed above each opening clamping portion. The combination plastic pallet with a backbone is formed after the bases are coupled together as such. Furthermore, since the bases are combined, one single base can be replaced if damaged.

15 Claims, 6 Drawing Sheets

PLASTIC PALLET STRUCTURE

CROSS-REFERENCES TO RELATED APPLICATIONS

This non-provisional application claims priority under 35 U.S.C. §119(a) on Patent Application No. 100118022 filed in Taiwan, R.O.C. on 2011 May 23, the entire contents of which are hereby incorporated by reference.

TECHNICAL FIELD

The present invention relates to a pallet structure, and more particularly to a partly replaceable plastic pallet structure, which can carry a light or heavy weight

BACKGROUND

Pallets are very common auxiliary tool in cargo transportation. A conventional pallet is a base similar to a platform, formed by nailing a plurality of interlaced wood strips or boards together; the top thereof is a mounting face for the placement of goods, and there are foot pieces below the mounting face to elevate the mounting face to allow goods placed on the mounting face to be kept off the ground, preventing the goods, which are otherwise too close to the ground, from being made wet, or being contaminated by pollutants on the ground.

The great majority of pallets available in the market currently are wood, paper, plastic and ferrous alloy pallets. The wood pallet is most widely used of these, but because the whole structure thereof is assembled from wood, a large amount of wood must be cut down before a certain amount of wood pallets can then be made; this is not congruent with environmental protection aims. Furthermore, the entirety of the wood pallet is fixed, so the whole wood pallet must be discarded as junk if even one part is damaged. In addition, the size of an assembled wood pallet is fixed; it cannot be folded for storage, and uses space inefficiently.

Similarly, since a pallet such as a paper, plastic or iron alloy pallet is limited by the weight it can bear that the other, the entire must be discarded as junk if the goods it carries are overweight, causing damage to even one part of the pallet; this is a waste of natural resources.

SUMMARY

To improve a pallet structure, increase usage convenience, and obtain a good bearing capacity, the present invention is proposed.

The present invention proposes a plastic pallet structure that can carry light or heavy weight goods and is partly replaceable, including a plurality of horizontal and vertical bases; each horizontal base includes a basic portion, including a plurality of opening retaining portions, extension portions, arch bridge portions and first and second supporting portions, where a three-dimensional mesh supporting structure is used to couple to each portion to form a three-dimensional base. Each vertical base is formed by means of plastic extrusion, including a basic portion, where the basic portion includes a plurality of opening clamping portions, extension portions, arch bridge portions, first and second supporting portions, where a three-dimensional mesh supporting structure is used to couple to each portion to form a three-dimensional base.

The plurality of horizontal bases and vertical bases are respectively cross linked together in horizontal and vertical directions at each opening clamping portion by means of opening-to-opening to form a plastic pallet with the plurality of horizontal bases and vertical bases. The opening clamping portion is preset with a slide-in slot; a cut line is reserved on the slide-in slot; a buckling element or tenon is preset along a joint of the cut line, allowing the two differently directional opening clamping portions to be slipped in each other along the slide-in slot, and locked by the buckling elements while two openings are respectively arrived at fixed positions, thereby bucking the horizontal and vertical bases to each other tightly. The slide-in slot has a certain elasticity due to the disposition of the cut line, allowing the buckling elements to be released easily while being separated, thereby forming a plastic pallet capable of being combined and detached.

The arch bridge in the present invention, is a bow-typed body formed by contracting one basic portion gradually inward between the two adjacent extension portions, allowing the forks of a forklift to be inserted. Both the horizontal and vertical bases have arch bridge portions for the forks of a forklift to be inserted; it is convenient for the forks to be inserted into the pallet in every direction. Forces acted on the arch bridge portion can be uniform, due to the disposition of the extension portions, so the base is not easily fractured.

The present invention also proposes a mesh-typed structure body, which is a three-dimensional mesh-typed structure of sheet body group formed by molding a soft plastic material into a mechanical structure intersected by means of X, Y, E and trapezoid structures, which generates stresses and is formed solidly to couple to each section.

The present invention further proposes a plastic pallet structure for a heavy load, including a plurality of horizontal and vertical bases, each horizontal base includes a basic portion, including a plurality of opening clamping portions, extension portions, arch bridge portions, a first supporting portion and a second supporting portion; in addition, it also includes a beam column passed through the base and a three-dimensional mesh-typed supporting structure coupled to each section.

The present invention also includes a plurality of vertical base; each vertical base includes a basic portion, including a plurality of opening clamping portions, extension portions, arch bridge portions, a first supporting portion and a second supporting portion. In addition, it also includes a beam column passed through the base and a three-dimensional mesh-typed supporting structure coupled to each section, where the three-dimensional mesh-typed supporting structure is made by plastic extrusion, formed into a combined sheet body group by means of X, Y, E, and trapezoid structures and the like to couple the all sections together to form the base.

Furthermore, the horizontal base and the vertical bases are engaged with each other diagonally and vertically through the corresponding opening clamping portion opening-to-opening, thereby combing the plurality of horizontal and vertical bases to form a plastic pallet with bidirectional beam columns included of the plurality of bases.

If the material of the beam column is the same as the other parts, the beam column can be integrated with the base, extension portion, arch bridge portion by means of extrusion, allowing the three-dimensional mesh-typed supporting structure and the beam column to be bonded tightly into one body like the trunk and the branches of a tree. A material other than the material of other parts may also be used as the beam column, such as metal, the beam needed may be installed in the base afterwards as long as an accepting space is formed at beam column placing points of each base in advance; for example, a circular hole, which is parallel to the opening clamping portions and passed through the base. is opened.

Consequently, the plastic pallet having the overlapping beam columns and capable of bearing a heavy weight can be formed after having the opening clamping portion, the slide-in slot in the opening clamping portion, the buckling element in the slipping-slot, the extension portions and arch bridge portions of the base, the supporting formed by coupling the mesh-typed structure body to every section, and the combination of the plurality of bases.

The present invention can increase the bearing capacity of a plastic pallet, avoid structural fractures or damage to buckling elements, replace parts quickly when a part is damaged, avoid the waste of resources, and further conform to environmental protection aims; saving energy, and reduce waste.

BRIEF DESCRIPTION OF THE DRAWINGS

The present invention can be more fully understood by reference to the following description and accompanying drawings, in which.

DETAILED DESCRIPTION

Figure 1:
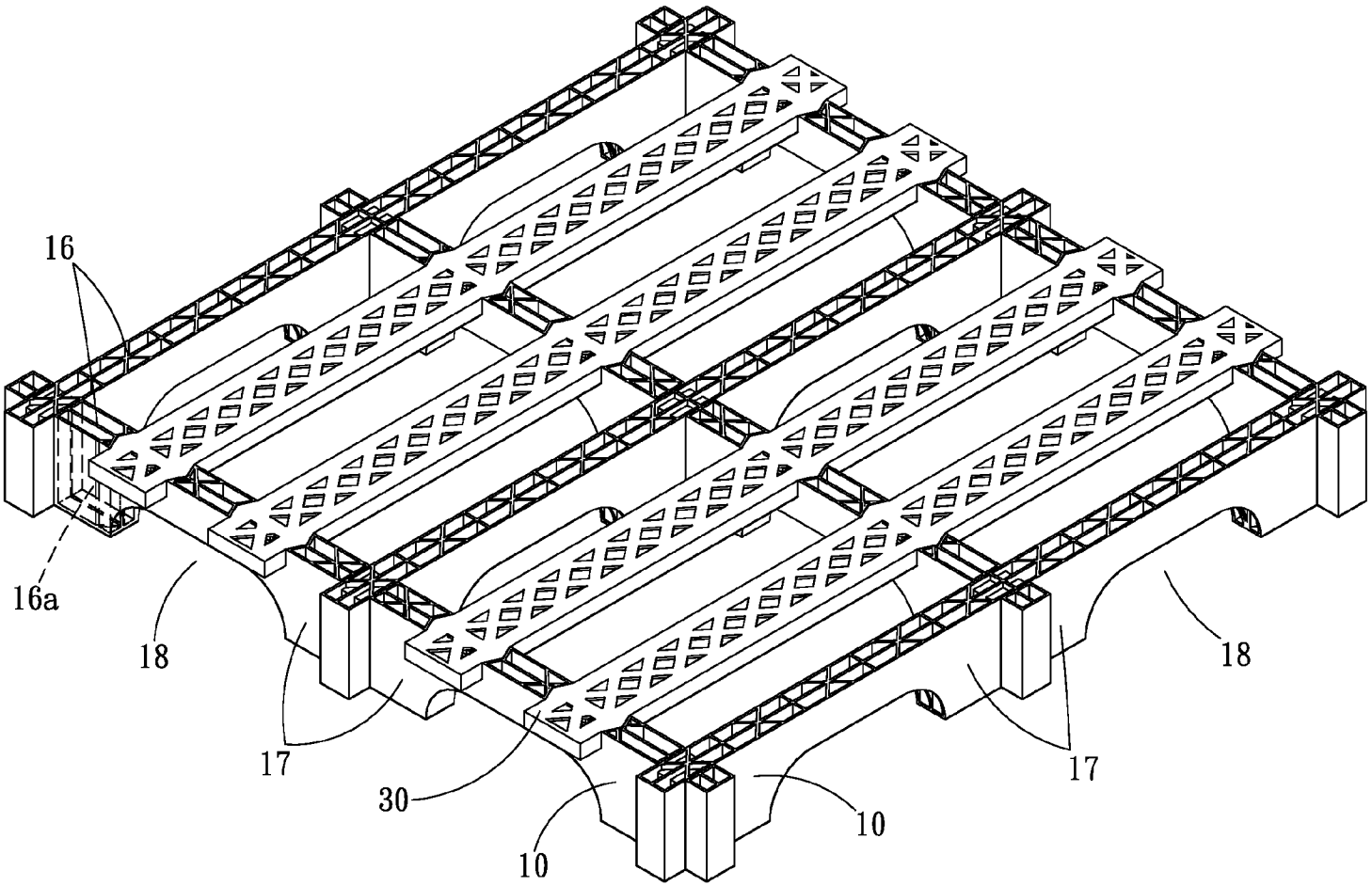
FIG. 1 is a perspective view of a plastic pallet of the present invention.
Figure 2:
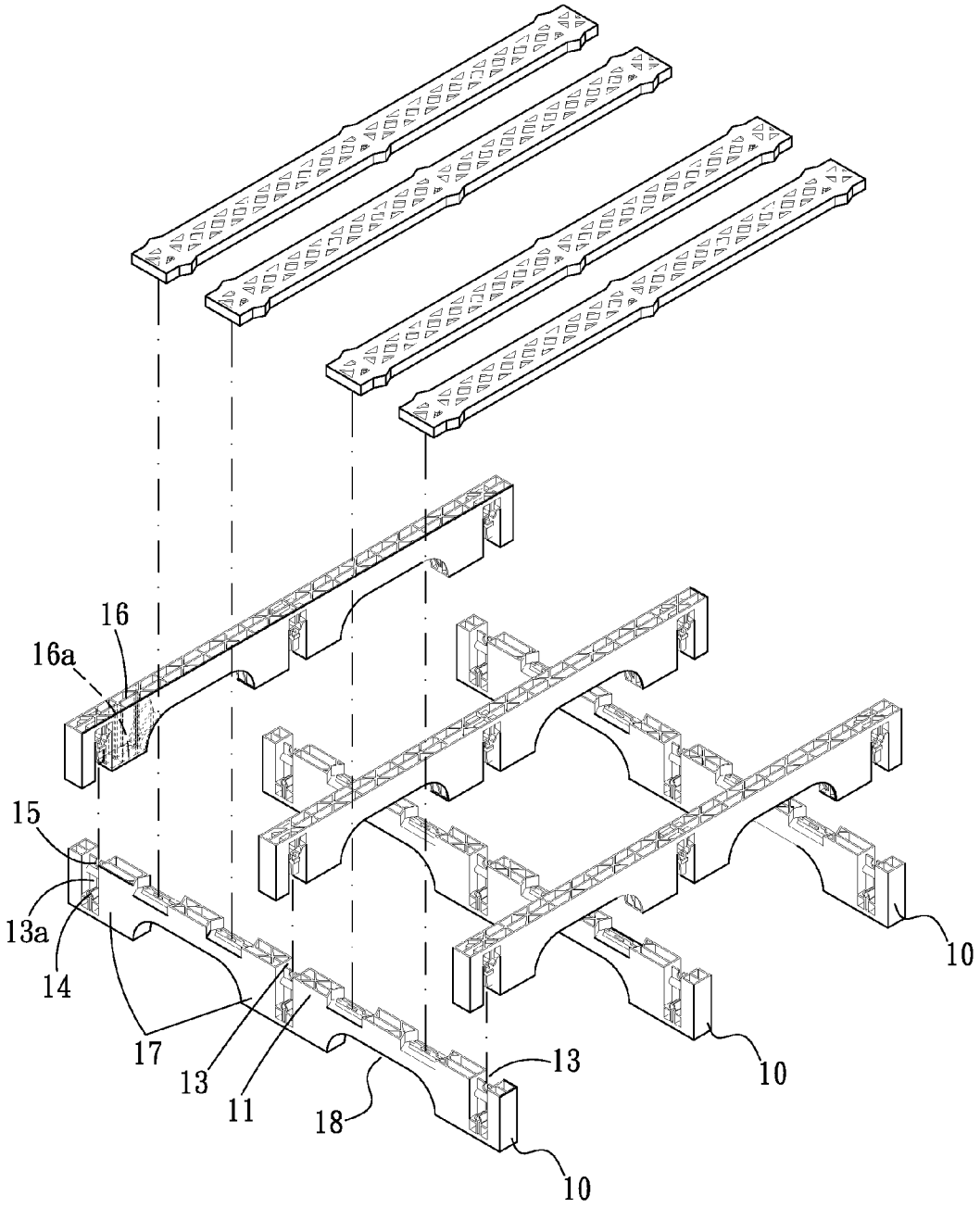
FIG. 2 is an exploded view of a plastic pallet of the present invention.

Please refer to FIGS. 1 and 2, in which a plastic pallet of a preferred embodiment according to the present invention is included of a plurality of bases 10 coupled together in a horizontal direction and a vertical direction, where each base 10 includes a basic portion 11, extension portions 17, arch bridge portions 18, a first supporting portion 16 and a second supporting portion 16*a*.

Please refer to FIG. 2, in which is shown an exploded view of a plastic pallet of the present invention. The horizontal base 10 approximately is a bar-typed rectangular sheet body structure, and may preferably be made from PE, PP or plastic synthetic material. The base 10 has the basic portion 11, where the basic portion 11 has a plurality of interval-arranged opening clamping portions. In the present embodiment, the number of the opening clamping portions 13 preferably is 3, but the present invention is not limited to this number; the number of the opening clamping portions 13 may be increased or decreased depending on a user's need. The shape of the opening clamping portion 13 aims at allowing the horizontal and vertical bases to engage with each other opening-to-opening, the outlook thereof approximately is rectangular, and the inside thereof is disposed with an opening so the opening-to-opening rectangles can clamp each other. Furthermore, a slide-in slot 13*a* may additionally be disposed inside the opening clamping portion 13, allowing the opening clamping portion 13 to be coupled to the slide-in slot 13*a*, where the slide-in slot 13*a* includes a triangular slip slot, but the present invention is not limited to this. To increase the coupling strength, a cut line 15 may further be disposed in the slide-in slot BS buckling element 14 is preset in the rear end of the cut line 15; the buckling element 14 preferably is a circular lock in order to allow the opening clamping portion 13 to be slipped into a corresponding opening clamping portion 13 smoothly while the two bases are coupled together. The bases can subsequently be coupled to each other tightly due to the automatic fastening of the buckling elements 14. Furthermore, since the cut line 15 is disposed on the slide-in slot 13*a* in advance, the base has elasticity due to a gap such that the two differently directional bases can be separated conveniently afterwards, thereby attaining the objects of replacing damaged parts and repeated pallet assembly, as a result of the simple detachment.

Additionally, the arch bridge portions 18 contracted into a bow shape are disposed in the basic portion 11, and each of them is formed between the two adjacent extension portions, thereby allowing the forks of a forklift to be inserted in the plastic pallet conveniently in a horizontal or vertical direction. In addition, the intersection of the two bases forms a cross, providing a solid weight-carrying base.

In the present embodiment, the first supporting portion 16 and the second supporting portion 16*a* are respectively formed to a mesh-typed structure body; upper, lower, left, right three-dimensional supporting groups are formed by coupling them to each section of the base by means of X, Y, E and trapezoid structures, allowing the plastic pallet to be lightweight and still have a good bearing capacity, and allowing a damaged base to be detached easily for replacement, while the plastic pallet maintains its original functions instead of discarding the entire, thereby enabling environmental protection by saving material and reducing waste.

Furthermore, to reduce the space between the horizontal base and the vertical base and prevent a small carried article from falling through a gap, embedded hollow plastic corner plates 30 made from a mesh coupling through plastic extrusion may be provided. A buckling structure 31 may respectively be disposed on the intersections with the base 10, allowing the plastic corner plate 30 to be buckled into the base 10 conveniently and quickly. Furthermore, bow-typed extensions made of a mesh-typed sheet body are disposed on the plastic corner plate 30 *b* and coupled to the base 10; it can further strengthen the compressive stress of the plastic corner plate 30.

The number of the horizontal and vertical bases 10 in the present embodiment depends on the weight carried by the pallet. The pallet may be included of four bases, six bases or eight bases, collocating with the plastic corner plate 30 positioned on each base 10. The number of bases 10 mentioned above is exemplary and explanatory only, the present invention is not limited to these.

Figure 3:
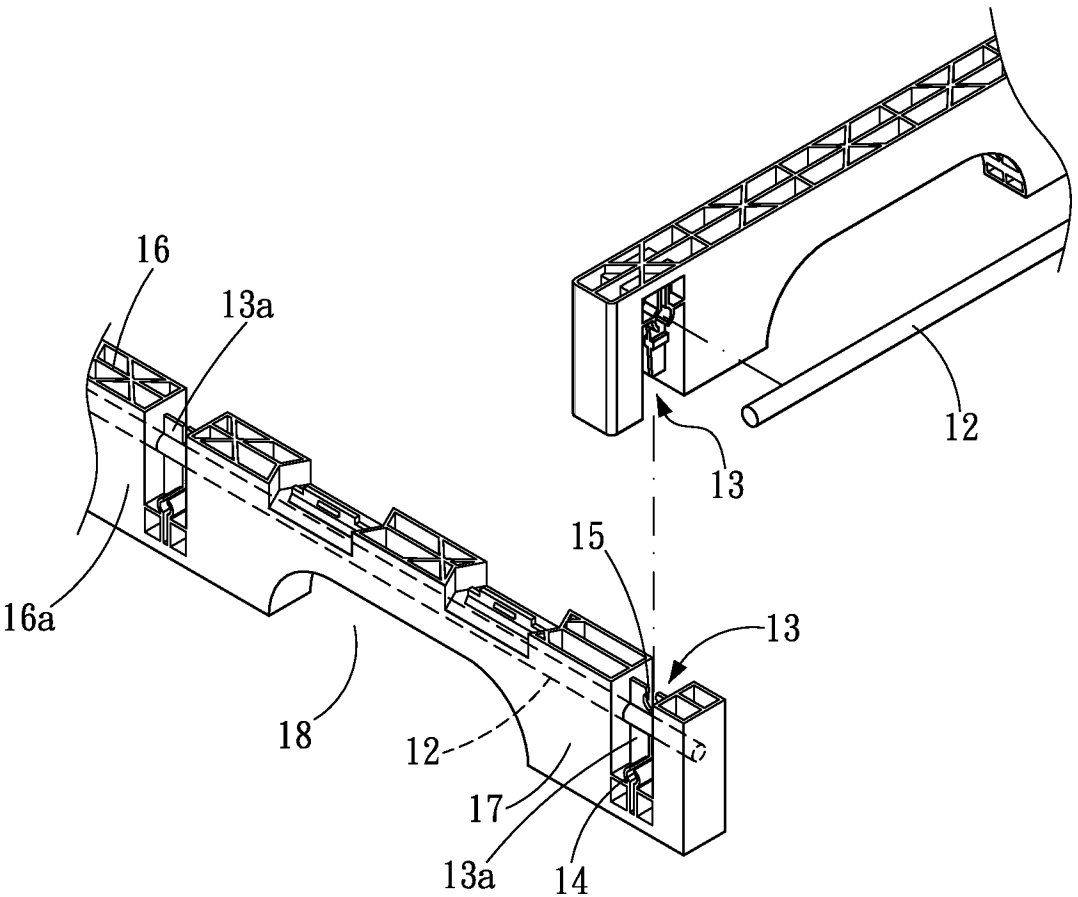
FIG. 3 is an exploded view of a horizontal base and a vertical base of the present invention.

Please refer to FIG. 3, which is a detachable plastic pallet structure with beam columns 12 of a second preferred embodiment according to the present invention. To strengthen the bearing capacity of the plastic pallet, the present invention proposes especially a detachable plastic pallet with structure beam columns 12. The beam column 12 approximately is a bar-typed circular column; it is preferably made from metal, such as iron, aluminum alloy, but the present invention is not limited to these. The disposition method thereof has the following steps: first, forming horizontal and vertical bases 10 from plastics by means of pressure casting in advance depending on a structure requirement. The horizontal base 10 mainly includes a basic portion 11, a plurality of opening clamping portions 13, a plurality of extension portions 17, a plurality of arch bridge portions 18, and the sheet body made from plastics by means of pressure casting is used to couple to the main portions by means of steel beam connected mesh-typed structure body so as to form the mesh-typed structure body as a support. The area of the upper layer of the mesh-typed structure sheet body, i.e. the basic portion is called as a first supporting portion 16. And the area of the lower layer thereof, i.e. the extension portion 17 is called as second supporting portion 16*a*.

The vertical base 10 also mainly includes a basic portion 11, a plurality of opening clamping portions 13, a plurality of extension portions 17, a plurality of arch bridge portions 18; the reason that it is defined as the vertical base 10 is because the opening of the opening clamping portion 13 faces downward. Similarly, a sheet body made from plastics by means of pressure casting is formed into a mesh-typed structure of sheet body by means of the steel structure of the connection of steel beams in architecture through plastic pressure casting; the sheet body is used as a basis to couple to each portion, forming a supporting portion of the base 10.

Furthermore, the beam column 12 is installed in advance; the beam column 12 is used for increasing a bearing capacity of the base 10 after being combined therewith; the beam column is installed extraordinarily at the set positions of the opening clamping portions 13 of the base 10 as FIG. 3 shows, thereby forming a plastic pallet with the crisscross beam columns 12 after the horizontal and vertical bases 10 are coupled together. As a result, the weight and pressure resisting capabilities of the pallet of the present invention can be increased.

A method for installing the beam column 12 in advance includes an integral forming: in the horizontal and vertical bases 10, pre-making the beam column 12 and pre-planning the connection between the beam column 12 and the sheet body of the first supporting portion 16 while installing the sheets (the first supporting portion 16 and the second supporting portion 16*a*), coupled to each main site, and an integration is completed after pressure-casting plastics by means of taking the beam column 12 as a center to forum a united body including such features as X, Y, and H structures, forming a horizontal or vertical detachable base 10 with the beam column 12 used for forming a steel type of structure body capable of bearing a heavy weight.

Figure 5:
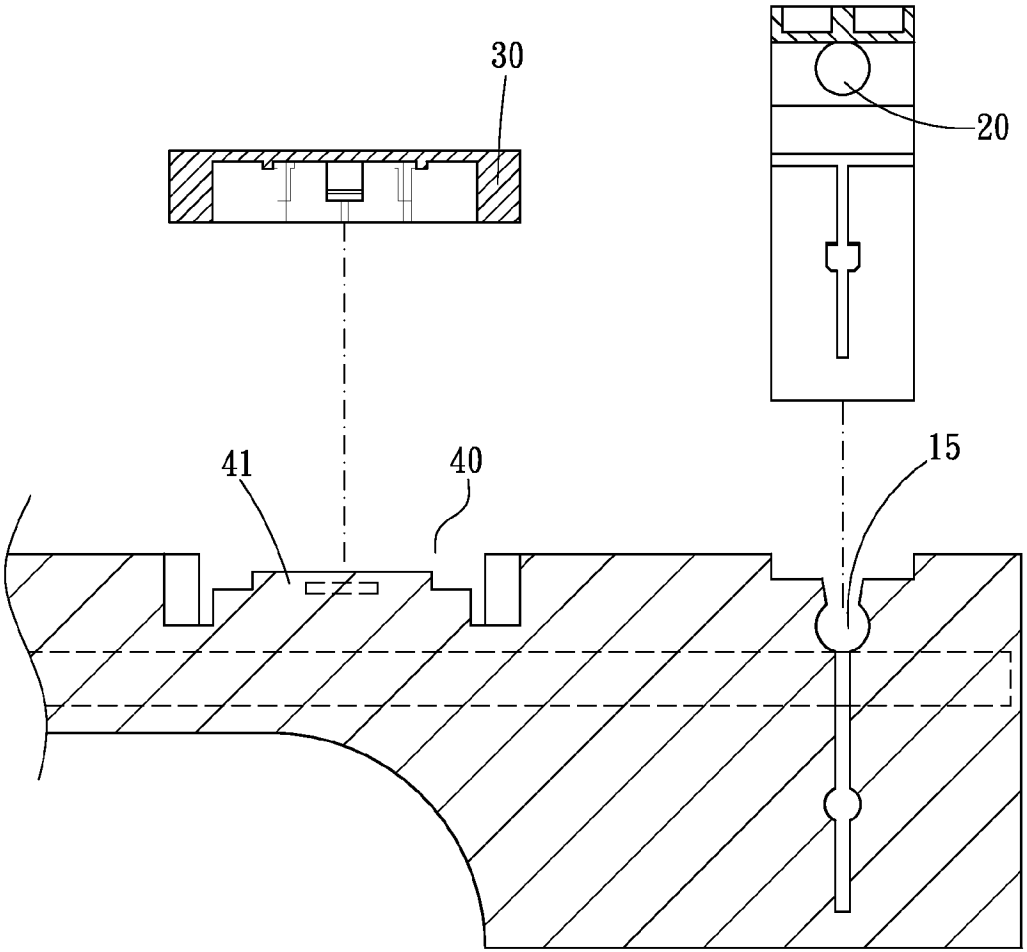
FIG. 5 is an exploded view of a horizontal base, a vertical base and a plastic corner plate of the present invention.
Figure 6:
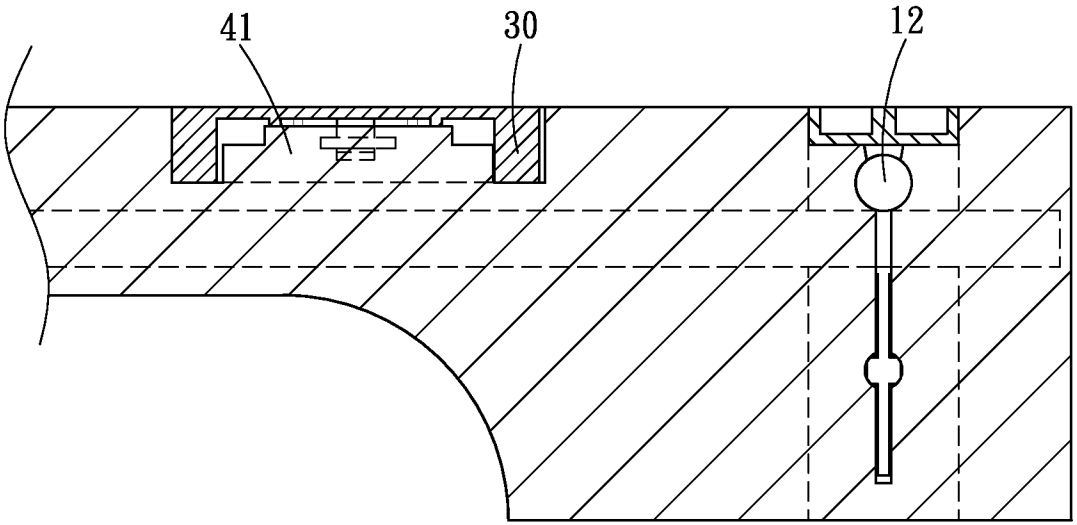
FIG. 6 is a cross section view of the combination of a horizontal base, a vertical base and a plastic corner plate of the present invention.

The installment method further includes a space reservation method: pre-measuring and pre-positioning an accepting space 20 for placing a metal material on every site of the horizontal and vertical bases 10 while the sheet body of the first supporting portion 16 is connected as FIGS. 3, 5 and 6 show, allowing the placement position to be completed after the base 10 is integrated into one body. At this time, a metal bar with a required diameter may be inserted from the outside depending on requirements. Furthermore, an engagement lock (not shown in the figures), may also remain since a position is reserved in advance, allowing the placed-in bar to be retained after the horizontal and the vertical based are connected tightly to each other. If there is a need for the beam column 12 to be taken out, the engagement lock can simply be opened, and the beam removed.

The horizontal and vertical bases 10 with the beam column 12, are both coupled to each other by engaging the opening clamping portions 13 thereof with each other, as FIG. 3 shows. The multiple bases 10 are coupled together to constitute an independent pallet as FIG. 1 shows. The present invention also provides the plastic corner plate 30, to reduce a gap between the two adjacent bases.

Figure 4:
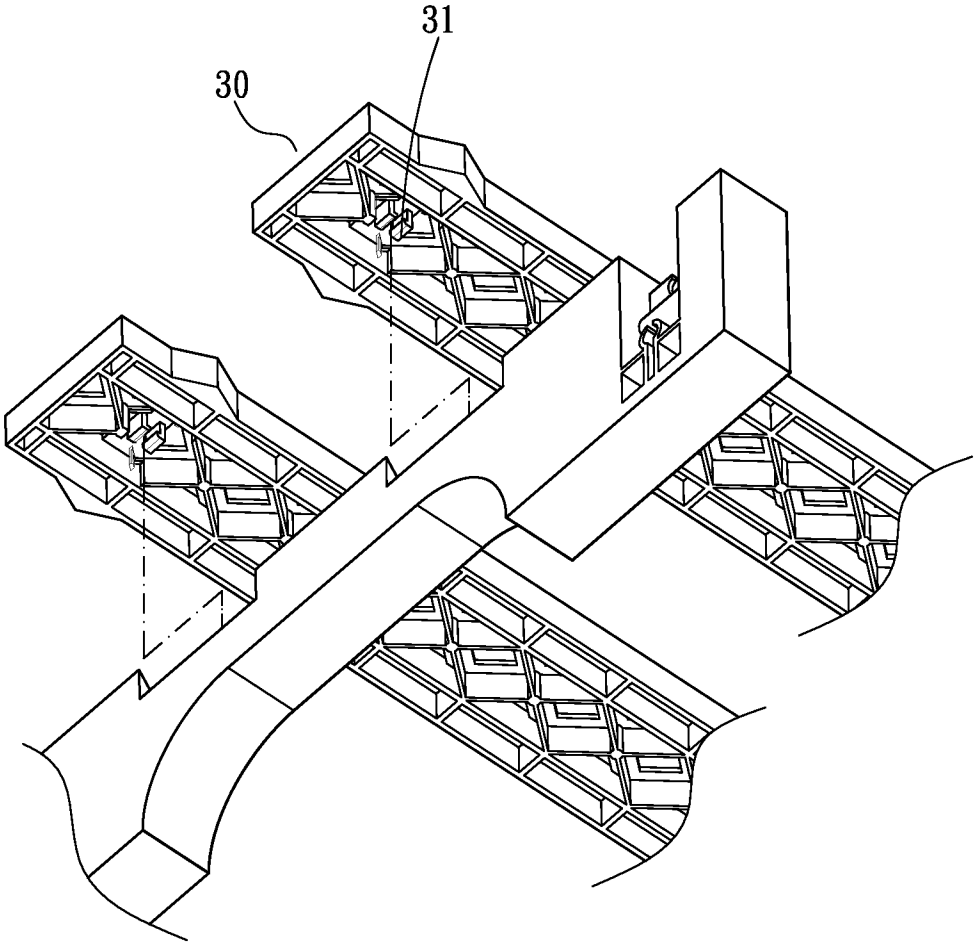
FIG. 4 is an exploded view of a horizontal base and plastic corner plate of the present invention.

Please refer to FIGS. 3 and 4, in which the plastic corner plate 30 includes coupling the plastic mesh-typed structures together, and the buckling structure 31 is respectively disposed on a contact position of the base 10 and a contact position of the plastic corner plate 30 corresponding thereto. The buckling structure 31 may preferably be an upper, lower composite active lock, a stackable button, a circular button or a hook clipper, used to couple the plastic corner plate 30 to the base 10. Furthermore, every basic portion 11 has a plurality of positioning groove 40, used for positioning the corresponding plastic plate 30. In view of this, the positioning groove 40 has a coupling element 41, used to couple the plastic corner plate 30 thereto, thereby allowing the plastic corner plate 30 to be coupled to the base 10 more tightly. If the corner plate 30 needs to be detached from the base 10, the tightly buckled coupling elements 41 may be released by way of pressing or swaying, and the plastic corner plate 30 can then be detached downwards.

The beam column of the present invention can increase the structural strength of the horizontal and vertical bases. The interlacing supporting portions formed through the hollow space in the seat bodies of the horizontal and vertical bases further increase the structural strength in the horizontal and vertical directions, thereby increasing the torque and diagonal shear, solving the problem of a conventional pallet in which a dynamic load cannot be carried, causing pallet breakage or damage to the buckling element used for the assembly.

The beams and the opening clamping portions of the horizontal and vertical bases are used to form the horizontal and vertical bases into a crisscross combination, thereby increasing the compressive torque and shear of the pallet. However, for lightweight transportation, the beam column structure may be omitted since the dynamic load of a heavy weight is unnecessary, though the opening clamping portions of each main body are still maintained. Furthermore, even the six or eight piece type combination is unnecessary; the four piece type combination with the corner plates is sufficient. The four pieces type combination is formed by crisscrossing, pressing and clamping the four bases together into a slotted shape, thereby achieving the objects of a flexible combination and saving material.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A plastic pallet structure, comprising:

a plurality of elongated horizontal and vertical bases, combined together in a horizontal direction and a vertical direction each base having a mounting face for the placement of goods and a lower surface for placement of the base on a supporting surface, and each base comprising:

a basic portion, comprising a plurality of opening clamping portions;

a removal beam column installed at set positions of the opening clamping portions closer to the mounting face than the lower surface, and extending along the longitudinal direction of the base;

at least one extension portion, connected to the basic portion;

at least one arch bridge portion, formed between two adjacent extension portions;

a first supporting portion, positioned on the extension portion; and a second portion, positioned on the basic portion, wherein the first supporting portion on and the second portion respectively form a three-dimensional mesh-type structure, the three-dimensional mesh-type structure being vertical to the mounting face; and at least one plate collocating with respective ones of the bases;

wherein, an opening direction of the opening clamping portions faces a first direction or a second direction to allow the bases to be combined together to form a plurality of co-constructed platforms, with the beam columns crisscrossing to increase a bearing capacity wherein the beam columns of the horizontal bases define a first plane, and the beam columns of the vertical bases define a second plane parallel to the first plane.

2. A plastic pallet structure, comprising:

a plurality of elongated horizontal and vertical bases, combined together in a horizontal direction and a vertical direction, each base having a mounting face for the placement of goods and a lower surface for placement of the base on a supporting surface, and each base comprising:

a basic portion, comprising a plurality of opening clamping portions;

at least one extension portion, connected to the basic portion;

a removable beam column positioned closer to the mounting face than the lower surface, and extending along the longitudinal direction of the base;

at least one arch bridge portion, formed between two adjacent extension portions;

a first supporting portion, positioned on the extension portion; and a second portion, positioned on the basic portion, wherein the first supporting portion and the second portion respectively form a three-dimensional mesh-type structure, the three-dimensional mesh-type structure being vertical to the mounting face; and at least one plate collocating with respective ones of the bases;

wherein, in each base, the beam column is installed in advance close to the opening clamping portions and positioned in the supporting portion, and being used to increase a bearing capacity wherein the beam columns of the horizontal bases define a first plane, and the beam columns of the vertical bases define a second plane parallel to the first plane, such that, a horizontal and vertical crisscross beam column pattern being formed after the corresponding opening clamping portions are coupled to each other.

3. The plastic pallet structure according to claim 2, wherein the beam column is passed through the base from the opening clamping portion, and the beam column is installed by combining the beam column with the first supporting portion by means of plastic casting, wherein the three-dimensional mesh-typed structure comprises X-typed, E-typed, Y-typed structures and a structure of a group of a combination thereof, used for forming a steel-structured structure body capable of carrying a heavy weight.

4. The plastic pallet structure according to claim 2, wherein the beam column is passed through the base from the opening clamping portion, and the beam column is installed by reserving an accepting space while the base is formed, inserting the beam column from the outside into the accepting space, thereby forming a base with the metal column.

5. The plastic pallet structure according to claim 1, further comprising a plurality of corner plates and a buckling structure, used for reduce a larger gap between each two adjacent bases, after the bases are combined together, wherein, the plastic corner plate is constituted using plastic sheet bodies by means of mesh type coupling; the corner plate is coupled to the base by the buckling structure at an intersection of the base and the corner plate; and the corner plate comprises an extension supporting sheet at the intersection, used to strengthen the compressive stress of the plastic corner plate.

6. The plastic paper pallet according to claim 5, being formed by combining four bases, six bases or eight bases together, where the corner plates are positioned on each base.

7. The plastic pallet structure according to claim 1, wherein the opening clamping portion comprises a slide-in slot and a fastening button, wherein the slide-in slot comprises a triangular slip slot, allowing the beam column to be slipped in to a predetermined position along the slide-in slot, buckled by the fastening button according to potential after being positioned, and the slide-in slot comprises a cut line, allowing the base to be elastic at the opening clamping portion after the two bases are butted up and down, thereby relieving pressure.

8. The plastic pallet structure according to claim 1, wherein the three-dimensional mesh-type structure formed into X-typed, Y-typed, E-typed, M-typed, rectangular structures and a structure of a group of a combination thereof from plastics by means pressure casting in advance, used for coupling to an inside of each face of the base.

9. The plastic pallet structure according to claim 1, wherein each base comprises a plurality of positioning grooves adapted to position supporting bars or supporting panels between the bases or the upper and lower pallets.

10. The plastic pallet structure according to claim 9, wherein each positioning groove at least comprises a coupling element, adapted to couple to each base.

11. The plastic pallet structure according to claim 10, wherein the coupling element is a composite lock, a stackable button, a circular button or a hook clipper, adapted to buckle the base automatically after being placed in, wherein the buckling is loosen by means of pressing or swaying to release the coupling element, a heavy-weight bearable combination plastic pallet being formed after coupling the bases together.

12. The plastic pallet structure according to claim 2, further comprising a plurality of corner plates and a buckling structure, used for reduce a larger gap between each two adjacent bases, after the bases are combined together, wherein, the plastic corner plate is constituted using plastic sheet bodies by means of mesh type coupling; the corner plate is coupled to the base by the buckling structure at an intersection of the base and the corner plate; and the corner plate comprises an extension supporting sheet at the intersection, used to strengthen the compressive stress of the plastic corner plate.

13. The plastic paper pallet according to claim 12, being formed by combining four bases, six bases or eight bases together, where the corner plates are positioned on each base.

14. The plastic pallet structure according to claim 2, wherein the opening clamping portion comprises a slide-in slot and a fastening button, wherein the slide-in slot comprises a triangular slip slot, allowing the beam column to be slipped in to a predetermined position along the slide-in slot, buckled by the fastening button according to potential after being positioned, and the slide-in slot comprises a cut line, allowing the base to be elastic at the opening clamping portion after the two bases are butted up and down, thereby relieving pressure.

15. The plastic pallet structure according to claim 2, wherein each base comprises a plurality of positioning grooves adapted to position supporting bars or supporting panels between the bases or the upper and lower pallets.

* * * * *